US006046701A

United States Patent [19]

Carey et al.

[11] Patent Number: 6,046,701

[45] Date of Patent: Apr. 4, 2000

[54] APPARATUS FOR HIGH-PERFORMANCE SECTORED ANTENNA SYSTEM

[75] Inventors: Douglas F. Carey, Nashua; Edward F. Dziadek, Mont Vernon; Christopher M. Moritz, Manchester, all of N.H.

[73] Assignee: Spike Technologies, Inc., Nashua, N.H.

[21] Appl. No.: 08/963,039

[22] Filed: Nov. 3, 1997

[51] Int. Cl.[7] ..... H01Q 3/14; H01Q 19/06

[52] U.S. Cl. ..... 343/753; 343/911 R; 343/753; 343/911 L

[58] Field of Search ..... 343/753, 911 R, 343/911 L

[56] References Cited

U.S. PATENT DOCUMENTS

| | | | |
|---|---|---|---|
| 2,943,358 | 7/1960 | Hutchins et al. | 18/58 |
| 3,321,765 | 5/1967 | Peters et al. | 343/911 |
| 3,470,561 | 9/1969 | Horst | 343/911 |
| 3,703,723 | 11/1972 | Albanese et al. | 343/18 D |
| 3,757,333 | 9/1973 | Procopio | 343/100 R |
| 3,787,872 | 1/1974 | Kauffman | 343/911 |
| 4,031,535 | 6/1977 | Isbister | 343/6.5 R |
| 4,268,831 | 5/1981 | Valentino et al. | 343/754 |
| 4,287,519 | 9/1981 | Doi | 343/725 |
| 4,359,741 | 11/1982 | Cassel | 343/754 |
| 4,523,198 | 6/1985 | Clapp | 343/754 |
| 4,531,129 | 7/1985 | Bonebright et al. | 343/754 |
| 4,626,858 | 12/1986 | Copeland | 342/374 |
| 4,723,123 | 2/1988 | Marlow et al. | 342/6 |
| 4,730,310 | 3/1988 | Acampora et al. | 370/95 |
| 4,755,820 | 7/1988 | Backhouse et al. | 343/700 MS |
| 4,806,932 | 2/1989 | Bechtel | 342/33 |
| 4,819,227 | 4/1989 | Rosen | 370/75 |
| 5,047,776 | 9/1991 | Baller | 342/52 |
| 5,115,248 | 5/1992 | Roederer | 342/373 |
| 5,260,968 | 11/1993 | Gardner et al. | 375/1 |
| 5,485,631 | 1/1996 | Bruckert | 455/33.3 |
| 5,548,294 | 8/1996 | Sturza | 342/372 |
| 5,703,603 | 12/1997 | Korzhenkov et al. | 343/753 |
| 5,748,151 | 5/1998 | Kingston et al. | 343/753 |

OTHER PUBLICATIONS

U.S. Application Serial No. 09/151,036, filed Sep. 10, 1998, entitled "High–Performance Sectored Antenna System Using Low Profile Broadband Feed Devices ", is a co–pending case.

*Primary Examiner*—Don Wong
*Assistant Examiner*—James Clinger
*Attorney, Agent, or Firm*—Wolf, Greenfield & Sacks, P.C.

[57] ABSTRACT

A sectored antenna system has one or more dielectric lenses, each having a surface and two or more antenna feed devices tilted non-parallel to the lens surface and preferably angled in a V pattern. At least one of the feed devices radiate signals into said lens that emerge as separate directional beams, or the lenses receive incoming signals from different directions and focus them onto different antenna feed devices. The feed devices of the sectored antenna system have a dielectric constant of between about 5 and 15 and preferable about 10 and further has a mounting collar to mount the antenna feed devices about the lens to adjust for elevation, azimuth, radial and rotational orientation.

29 Claims, 7 Drawing Sheets

APPARATUS FOR HIGH-PERFORMANCE SECTORED ANTENNA SYSTEM

FIELD OF THE INVENTION

This invention relates generally to the field of wireless communications, and more particularly to high-performance sectored antenna systems.

BACKGROUND OF THE INVENTION

The rapid expansion of the wireless communications industry has increased the demand for frequency spectrum such that operators must be sure to use the spectrum as efficiently as possible. Innovative digital modulation and compression techniques, as well as spatial techniques such as cellularization and sectoring can be used to increase spectral efficiency.

Digital modulation is currently the most common method of transmitting information. It is more reliable and more spectrally efficient than its predecessor, analog modulation.

There are several popular techniques of digital modulation. Binary Phase Shift Keying (BPSK) is a simple method wherein binary characters "0" and "1" are each represented by two different phases of a carrier frequency in a channel. By simply alternating between these two phases, a transmitter can convey digital information to the recipient. The repeated variations create a signal that occupies a finite bandwidth. This bandwidth can be calculated and is directly related to the data rate and the modulation scheme. The spectral efficiency of a modulation scheme is measured in "bits per hertz," a ratio that should be maximized. BPSK has an ideal spectral efficiency of 1 bit per hertz. Quadrature phase shift keying (QPSK), using four phases, is a more efficient modulation scheme, and has an ideal spectral efficiency of 2 bits per hertz.

As more data is transmitted through a given channel size, the condition of the channel becomes more important. A noisy channel can prevent the receiver's rf modem from recovering the data. Each type of modulation scheme has a certain tolerance to unwanted signals. This tolerance is measured in the desired-to-undesired signal ratio (D/U). As an example, for an error rate better than 10e-09, QPSK requires a D/U of 16 dB. QAM-64 modulation, however, has a higher ideal spectral efficiency of 6 bits per hertz, but is more demanding, requiring a D/U ratio of 29 dB. Higher levels of spectral efficiency have been achieved, but only at much higher component costs, and with much higher D/U requirements. Most of the current digital modulation schemes were conceived over twenty years ago, and attention has turned to other methods of achieving spectral efficiency.

Digital compression involves using mathematical algorithms to reduce the amount of data sent, without losing any of the information. Compression is most effective with data that repeats certain patterns, such as video data. Raw data that exhibits no repetitive qualities benefits less from digital compression.

In addition to digital techniques, spatial methods can be used to achieve similar goals. Most UHF and microwave communications systems employ spatial techniques to increase the efficiency with which frequency spectrum is used over a given geographical area. Cellular systems exploit the limited range of these rf signals by reusing the same channels among multiple cell sites. The "Reuse factor" quantifies the efficiency of the particular "cellular reuse scheme." It is the distance between the centers of two cells that reuse the same channel divided by the radius of a cell (D/R). This number should be minimized.

Sectoring involves dividing the coverage area (cell) into pie-shaped slices, making possible increased levels of frequency reuse. Popular cellular reuse schemes also employ a small amount of sectoring. Generally, cells are divided into three sectors, as is evident from the triangular shape of cellular antenna systems. This allows more flexible allocation of available channels across the cellular system, and to a lesser degree, increased reuse.

Highly sectored antenna systems greatly increase the amount of reuse that can be achieved. As shown in FIG. 1, two or more of the sectors (slices) use the same frequency spectrum, achieving a "perfect" reuse factor of 1. The first quadrant of a 360° coverage is shown sectored and sectors 29, 31 and 33 are depicted. Frequency 21 may be reused in another sector as shown; similar results can be achieved with frequency 23, 25 and 27, for example. Ideally, all of the sectors would use the same frequency spectrum, effectively multiplying the capacity of the spectrum by the number of sectors. For example, a 20 sector antenna system would lead to a 20-fold increase in capacity. But design issues affect the actual degree of sectoring that is achievable.

A sectored antenna system can consist of numerous discrete directional antennas colocated and aimed in different directions to establish a total 360 degree coverage. The aforementioned cellular systems use this method to divide cells into three sectors. However, highly sectored antenna systems are difficult to build and align using this method; there is a practical limit to the amount of sectoring that can occur. Also, such antenna systems are bulky and expensive due to the duplication of components.

A sectored antenna system is disclosed in U.S. patent application Ser. No. 08/677,413 for Focused Narrow Beam Communication System, incorporated herein by reference. This sectored antenna system utilizes one or more dielectric lenses. These lenses can be joined to create a hybrid lens device. In some cases, such a lens device may be analyzed and characterized as a single lens with unique properties. Such a lens is designed to have multiple focal points that serve as ports for the rf signals associated with each respective sector. Feed devices are mounted in close proximity to each desired focal point of the lens. The design of such feed devices is crucial to the performance of the sectored antenna system, and is a key element of the present invention. Microstrip or patch feed devices are used, though any appropriate feed devices may be employed.

Performance parameters for a sectored antenna system include gain, sidelobe and backlobe performance, and isolation among sectors. Feed device design affects all three of these parameters.

It is desirable to have high gain in the desired direction of each sector, with low sidelobe and backlobe levels to minimize the amount of radiation into other sectors. These objectives can be accomplished by increasing the size of the sectored antenna system, but it is desirable to keep the antenna system as small as possible. If such a sectored antenna system covers more than 90 degrees, it is likely that some feed devices will partially block the signals of other feeds, reducing the effective gain of those sectors of the antenna system. Such blockage must be reduced, but not at the cost of other design parameters.

Typically, lenses used in conjunction with a microstrip patch feed having low dielectric constant such as about 2.5 have been used and advantages of these appear in literature.

SUMMARY OF THE INVENTION

In accordance with a preferred embodiment of the invention a sectored antenna system comprises one or more dielectric lenses, each having a surface, and two or more antenna feed devices tilted non-parallel to the lens surface. The feed devices radiate signals into the lens that emerge as separate directional beams, or the lenses receive incoming signals from different directions and focus them onto different antenna feed devices, or a combination thereof. In an illustrated form, the antenna feed devices are angled in a V pattern.

In accordance with another preferred embodiment of the invention, a sectored antenna system comprises one or more dielectric lenses and two or more antenna feed devices, where at least one feed device has a dielectric substrate of between about 5 and 15, and preferably about 10.

In accordance with another preferred embodiment of the invention, a sectored antenna system comprises one or more dielectric lenses, two or more antenna feed devices, and a means to mount the feed devices about the lens to adjust for elevation and azimuth orientation.

OBJECTS OF THE INVENTION

An object of this invention is to create a high-performance, yet compact sectored antenna system that reduces sidelobe and backlobe radiation.

Another object of this invention is to create an efficient method of feeding signals into and out of a dielectric lens device.

Another object of this invention is to reduce coupling among sectors in a sectored antenna system.

A further object of this invention is to reduce design and alignment time in a sectored antenna system.

Yet another object of this invention is to create a sectored antenna system suitable for the delivery of broadband signals.

Another object of this invention is to create a sectored antenna system with a high desired-to-undesired (D/U) ratio.

Other objects and advantages of the present invention will become apparent from the following description, taken in connection with the accompanying drawings, wherein, by way of illustration and example, embodiments of the present invention are disclosed.

DETAILED DESCRIPTION OF THE PREFERRED EMBODIMENT

One way to reduce blockage, discussed above, is to use smaller feed devices. In order to design smaller microstrip or patch feed devices, a substrate with higher dielectric constant must be used. This has two direct effects: (i) A reduction in the directivity of the feed device, and (ii) a reduction in the gain of the feed device beyond that caused by the reduction in directivity. The reduction in directivity means that more of the signal coupling into the lens will require refraction to get it going in the right direction. Assuming the same lens, this leads to higher sidelobes radiation, which is undesirable. But the lower directivity of the feed device may allow more flexibility when tuning the antenna system, as noted below, partially offsetting the negative factors. And the smaller size of these feeds helps to reduce unwanted coupling among devices. But higher dielectric constant feed devices also have greater internal loss, negatively impacting the gain. This is always undesirable.

Lower dielectric constant feed devices have greater directivity and gain, which has a positive impact on sidelobe radiation levels, but the increased size of these feeds counters the benefit. Also, the larger feeds tend to couple with one another, resulting in decreased isolation among sectors, a negative.

Together, these parameters affect the level of desired-to-undesired signals (D/U) throughout the antenna system. It is desirable to maximize the D/U ratio so that more sophisticated digital modulation techniques can be used, resulting in broadband transmission with increased overall capacity.

Figure 1:
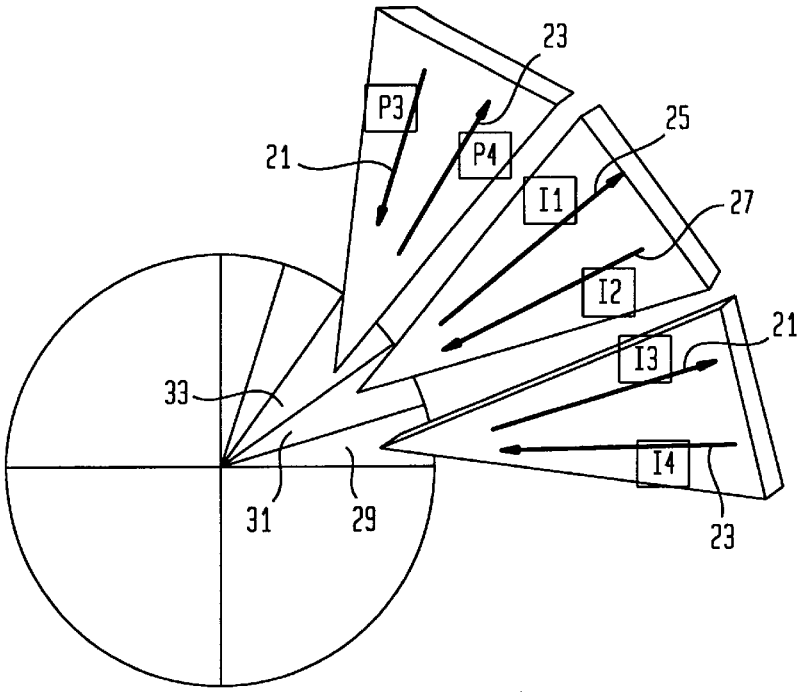
FIG. 1 illustrates frequency reuse in a sectored antenna system.
Figure 2:
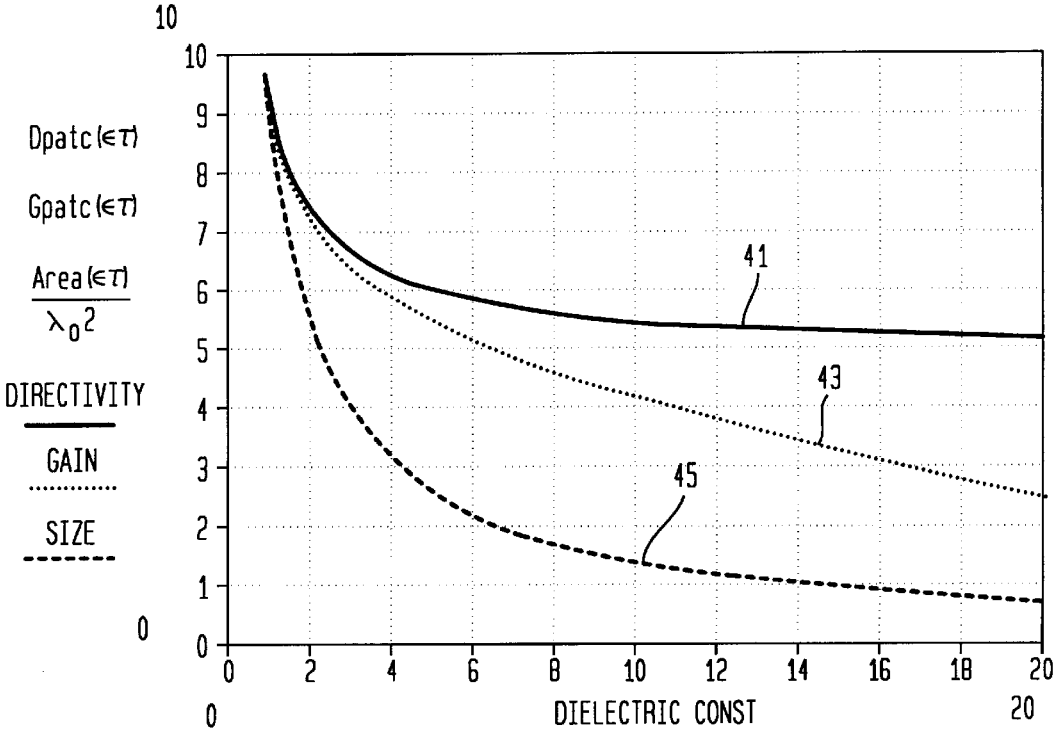
FIG. 2 is a graph illustrating how directivity, gain and size of microstrip patch feed antennas decrease with increasing dielectric constant of the feed substrate.
Figure 3:
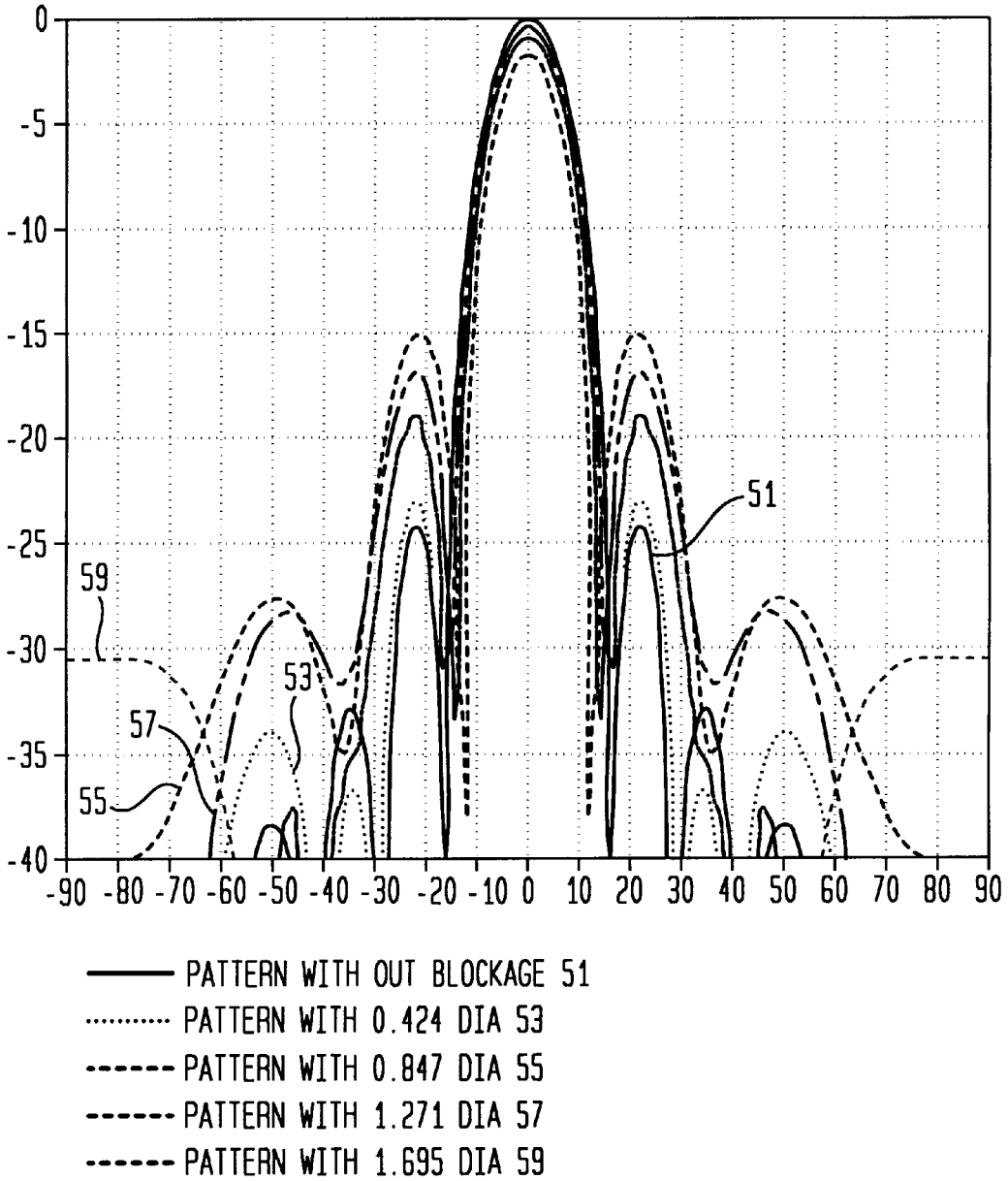
FIG. 3 is a graph illustrating the effect of aperture blockage on sidelobe performance.
Figure 4:
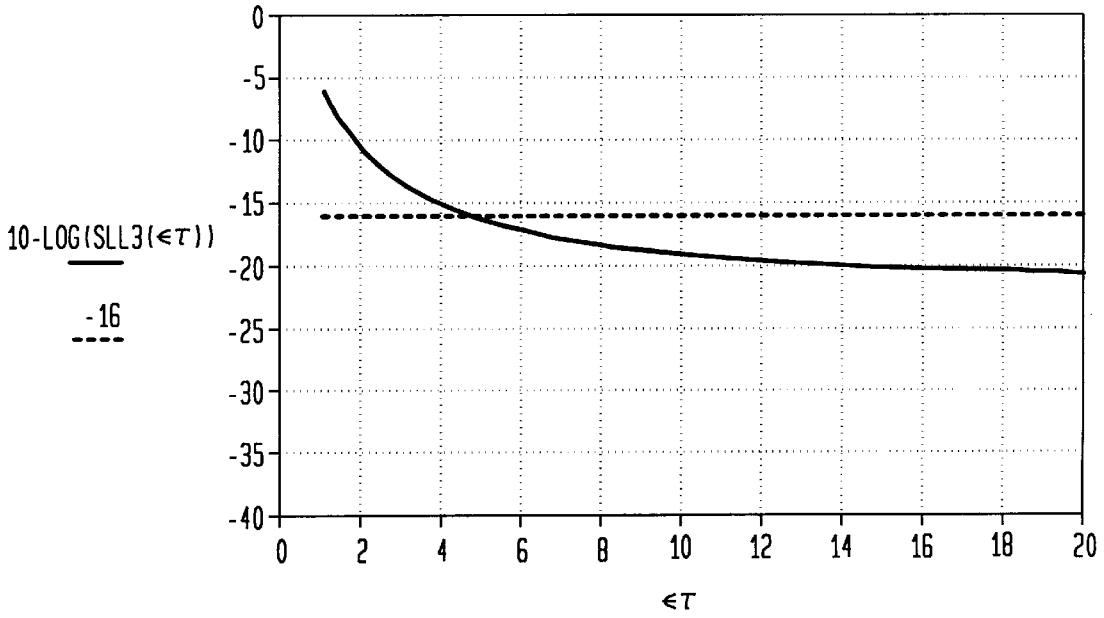
FIG. 4 is a graph illustrating how backlobe and sidelobe levels increase due to increase in gain and increasing feed size with decreasing dielectric.
Figure 5:
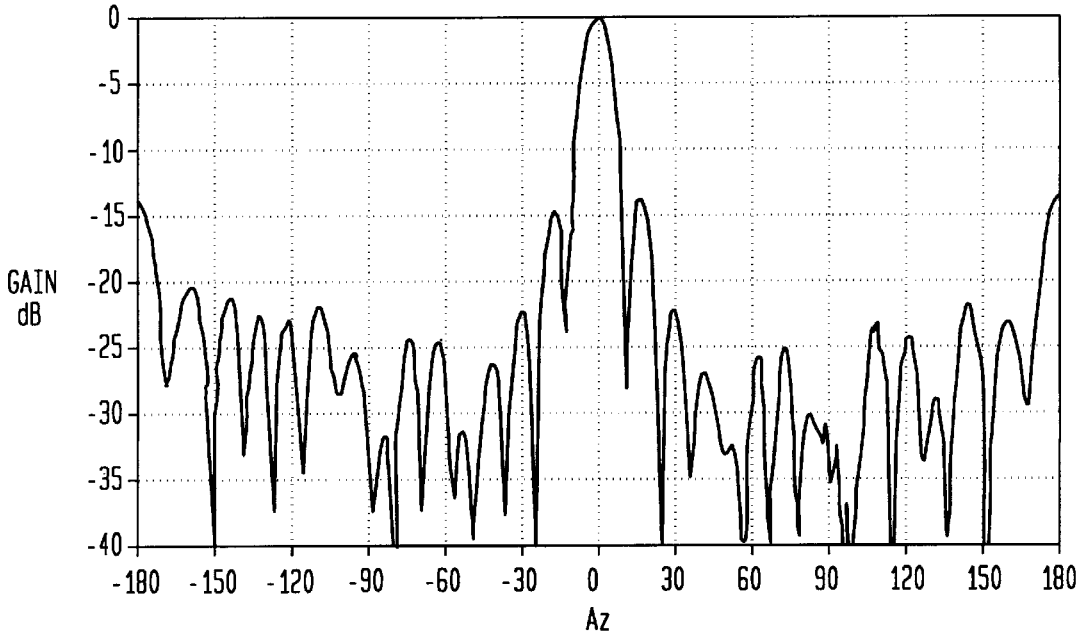
FIG. 5 is a graph illustrating an example of empirical data used to correlate backlobe levels to dielectric constant of the microstrip patch device.
Figure 6:
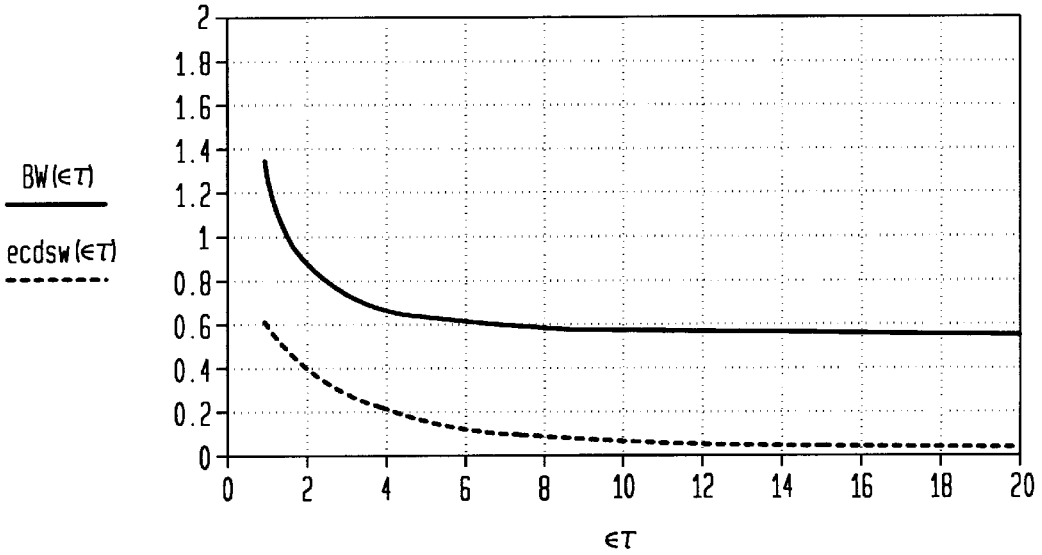
FIG. 6 is a graph illustrating efficiency and bandwidth decreasing with increasing dielectric constant of the microstrip patch device.

As the dielectric constant approaches 1 the size of the patch increases, thereby increasing not only the aperture blockage but also the reflective area (cross section). FIG. 2 shows how the directivity, gain and size of the patch decrease with increasing dielectric constant. Directivity is shown at line 41, while gain is shown at line 43 and size at line 45. From this graph one can correlate aperture blockage to dielectric constant of the microstrip patch device. The effect that aperture blockage will have on peak gain and on side lobe performance can then be calculated. FIG. 3 shows the effect of aperture blockage on sidelobe performance. An aperture having no blockage is depicted at line 51, while line 53 depicts a radiation pattern having a 0.424 wavelength diameter blockage. Similarly, a radiation pattern for a blockage diameter of 0.847 wavelengths is shown at line 55, at line 57 at a blockage diameter of 1.271 wavelengths and line 59 a 1.695 wavelength blockage diameter. FIG. 4 shows how back lobe (and side lobe) levels increase due to the increase in gain and increasing feed size with decreasing dielectric constant. This shows theoretical limits and correlates well with empirical data (FIG. 5) and indicates that a dielectric constant greater than 5 must be used to give adequate performance. FIG. 6 shows how efficiency and bandwidth decrease with increasing dielectric constant of the microstrip patch device. To maintain a useful bandwidth, a dielectric constant of less than 15 must be used. These two constraints bound the practical useful range of dielectric constant between 5 and 15 for use in a multi-sectored lens antenna. The current invention uses a dielectric constant of about 10.

During the assembly of the antenna system, certain types of feed devices can be fine-tuned by physically moving them in relation to the lens. This helps to achieve the overall performance goals for the antenna system. Some feed devices can be rotated to change their angular alignment with respect to the lens. This feature adds flexibility to the tuning procedure and can result in better overall performance for the antenna system. It is desirable for feed devices to benefit from angular as well as spatial movement with respect to the lens during the alignment process.

The present invention utilizes an array of planar microstrip or patch feed devices that are attached to a mounting apparatus. The mounting apparatus is generally physically attached to the lens, but can also be attached to the lens mount or some other stationary object. The feed devices can have an equivalent dielectric constant anywhere between about 5 and 15, and preferably about 10. As indicated above, dielectric constants outside of this range do not perform adequately.

The following discussion depicts operation in transmit mode. The same issues apply in receive mode, and can be understood by simply reversing the direction of the beams depicted in the various figures.

Figure 7:
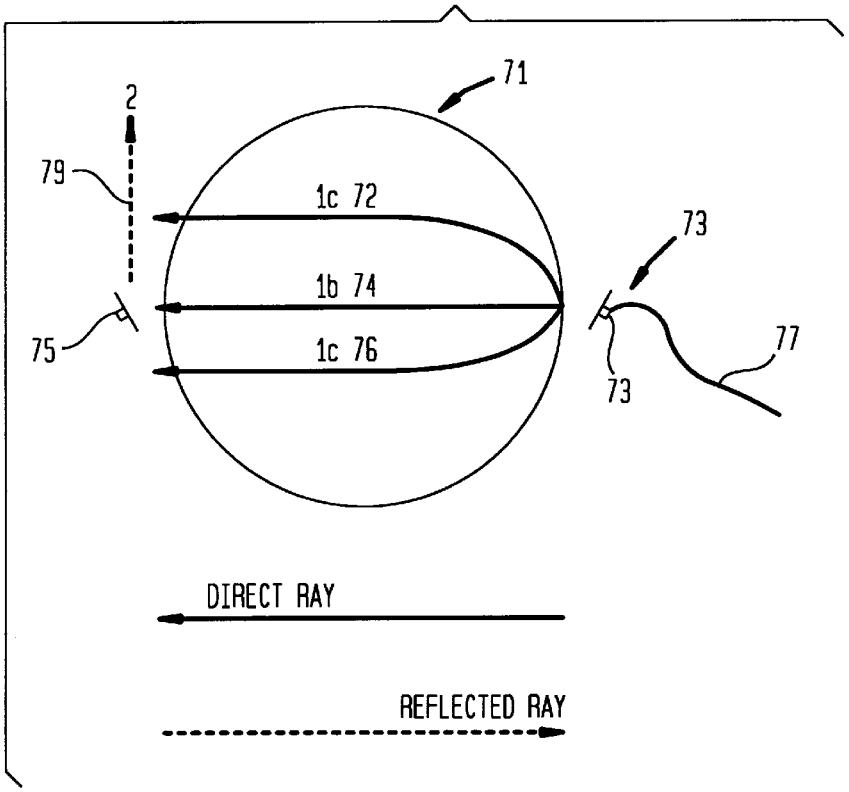
FIG. 7 shows an antenna system according to the present invention.
Figure 8:
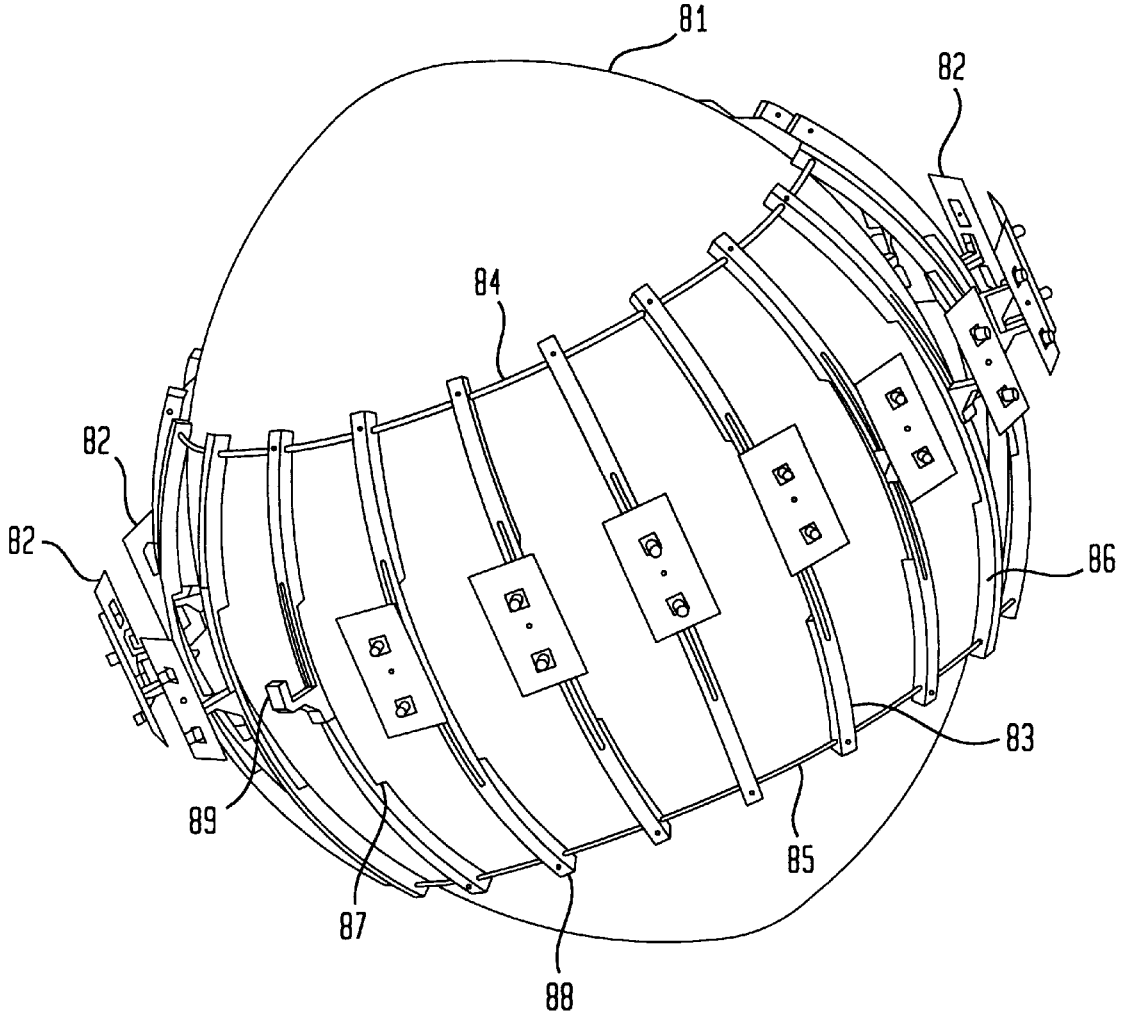
FIG. 8 shows an antenna mounting apparatus according to the present invention.

FIG. 7 is a schematic diagram depicting an embodiment of the present invention. It includes a dielectric lens 71 being fed by a planar feed 73 such as a patch, connected to signal cable 77. The lens focuses the signal illustrated at 72, 74 and 76 from feed device 73, creating a pattern similar to that formed by a parabolic dish antenna. For a sectored antenna system, multiple feeds are used, so that the system mimics multiple parabolic dishes. The feed array is mounted to the lens using a lens collar as shown in FIG. 8. Although this embodiment displays good results, the performance can be further improved through use of V shape configured feed devices as described below. The feed devices may be of a variety of types and designs, though in the illustrated embodiment are made from substrate material having a dielectric constant between about 5 and 15 in any of a number of known methods.

Figure 9:
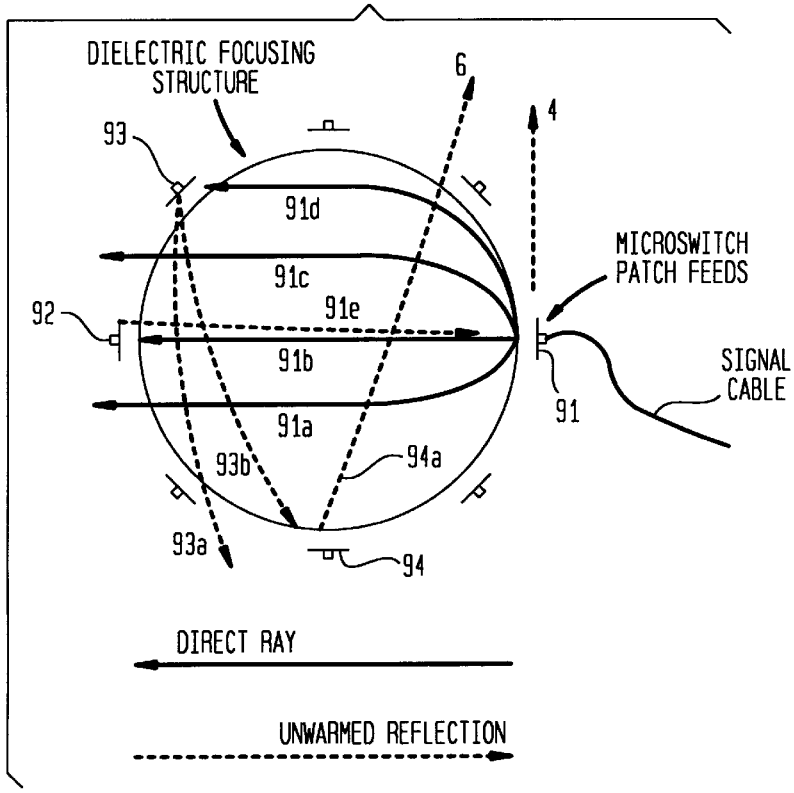
FIG. 9 shows an antenna system with multiple parallel antennas also showing sidelobe and backlobe radiation.

FIG. 9 shows another embodiment, with additional lines depicting reflections that can occur and feeds parallel to the surface of the dielectric lens. The bold lines 91*a*–91*d* depict the desired signal passing through the lens from feed 91. A portion of this desired signal will hit feed 92 and will be reflected back through the lens, emerging from the other side as a backlobe 91*e*. It is important to note that the entire lens participates in the refraction of the signal. Note that signal 91*d* from feed 91 hits feed 93, causing a reflection 93*a*–93*b* that mostly travels back into the lens, emerging as sidelobe radiation. Again, signal 93*b* can hit feed 94, causing yet another reflection 94*a,* and therefore additional sidelobe energy. The feed devices 91, 92, 93 and 94 are made from substrate material having a dielectric constant between about 5 and 15, and preferably about 10.

A preferred embodiment of the current invention is illustrated in FIG. 7. Note that the feed devices 73 and 75 are tilted with respect to the surface of the lens. The signal 72, 74 and 76 is transmitted from feed 73 through the lens. Signal 74 hits feed 75 and is reflected away from the lens as shown as line 79. This causes a substantial decrease in backlobe levels. But signal 79 is still an unwanted sidelobe. This is why mobility of the feed devices is important. The tilt angles can be adjusted to obtain the minimum sidelobe levels. When numerous feeds are used, the process can be largely empirical, but software could be developed to calculate these parameters. The distance between the feed and the lens also contributes to minimizing the sidelobe levels.

Figure 10:
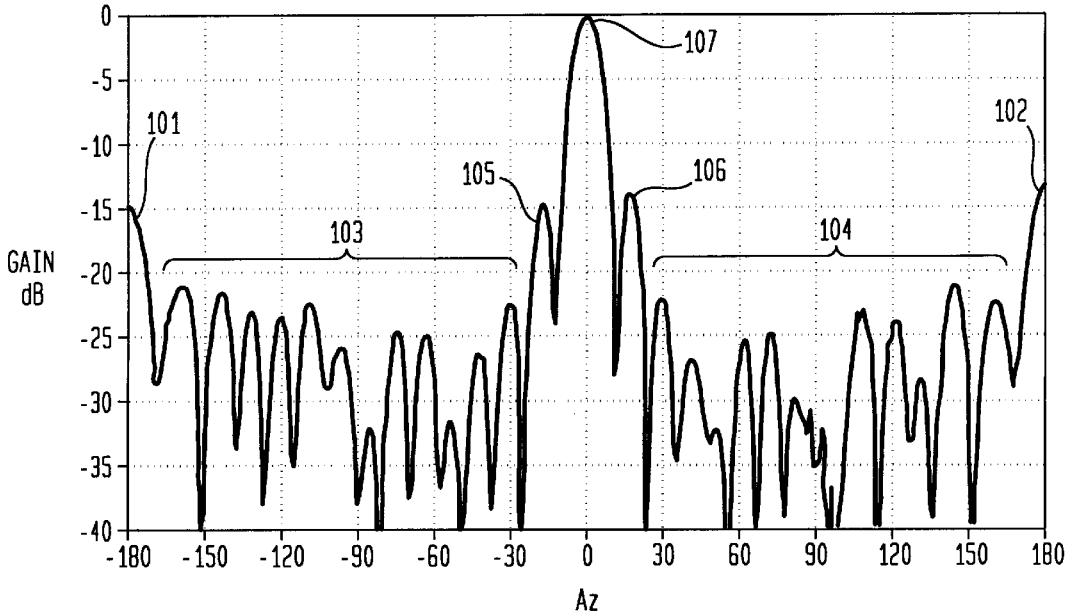
FIG. 10 is a graph illustrating the radiation pattern for a single sector of FIG. 9.

The results from these adjustments are quite good. FIG. 10 shows the antenna pattern for a single sector, showing the main beam at 107 corresponding to rays 91*a*–*d* of FIG. 9, the back lobe 101 and 102 and the sidelobes 103, 104, 105, and 106. In this case, a planar microstrip patch antenna feed was used to feed the lens, and such feed was positioned parallel to the surface of the lens. Twenty of such feed devices were mounted in this case. Note the backlobe 101 of 14 dB. Note the sidelobes 103 and 104 average approximately −25 dB, and the first sidelobes 105 and 106 closest to the main lobe are 14 dB. It is desirable for all of these (except for the main beam 107) to be minimized.

Figure 11:
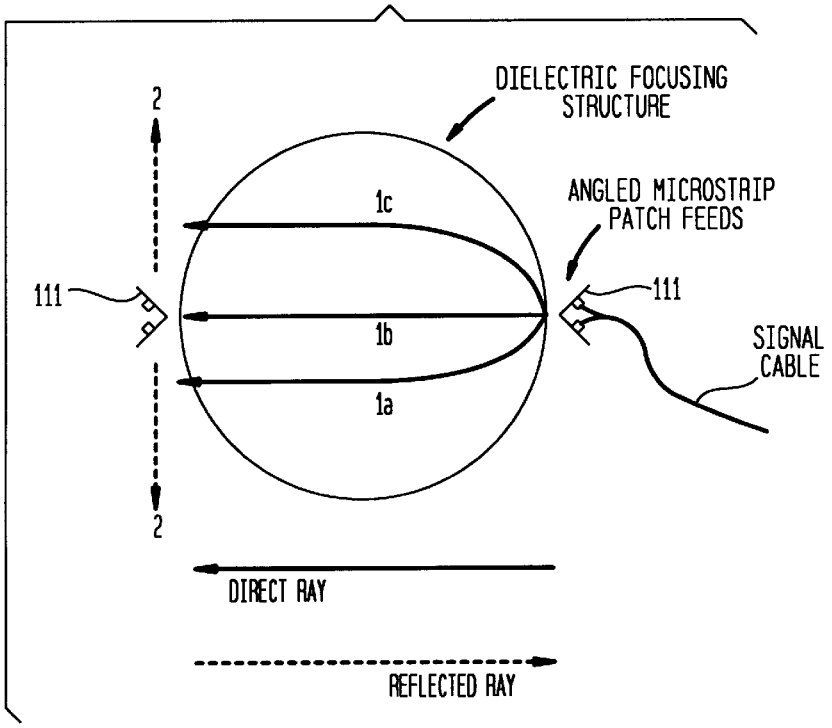
FIG. 11 shows another embodiment of the angled antenna according to the present invention.
Figure 12:
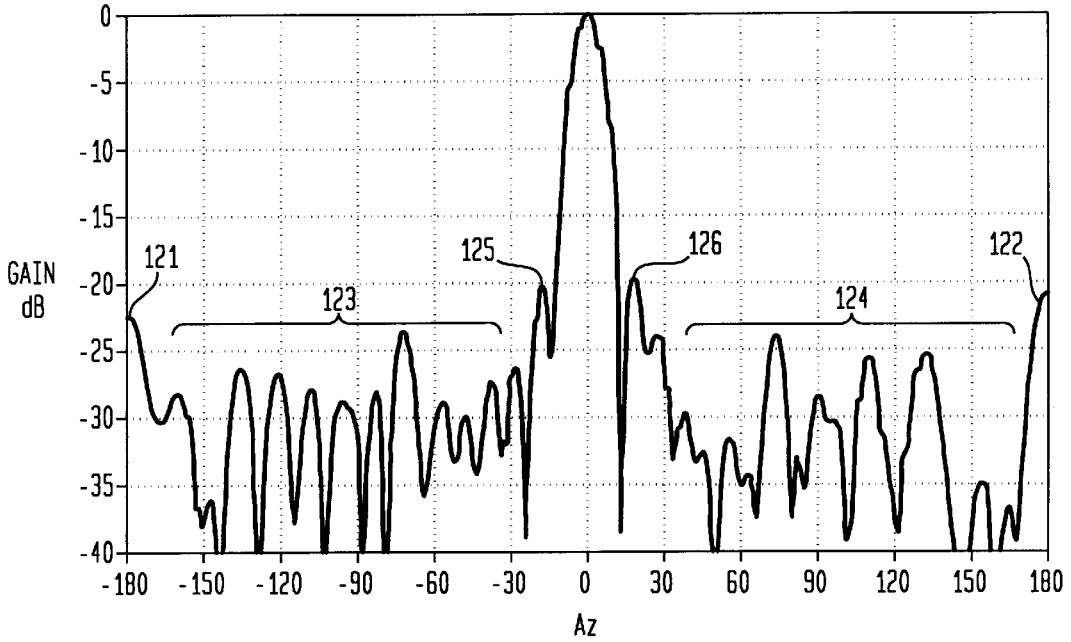
FIG. 12 is a graph illustrating the radiation pattern for a sector of FIG. 11.

FIG. 11 shows another embodiment of the present invention. This embodiment utilizes dual planar feed devices 111 angled in a "V" pattern as shown. Each device contains two planar feeds, one for transmitting and one for receiving. The feeds were positioned for minimum backlobe and sidelobe levels. Note in FIG. 12 the reduced backlobe levels 121 and 122 of −21 dB, a 7 dB improvement. Note the reduced first sidelobe levels 125 and 126 of 20 dB, a 6 dB improvement and the other sidelobes 123 and 124 that average approximately −30 dB, a roughly 5 dB improvement.

As mentioned above, all of the sidelobe, backlobe and other issues described herein apply to an antenna system in receive mode. The present invention works in receive mode, and delivers all of the benefits that occur in transmit mode. In summary, the signals from the various sectors arrive at the lens device from different directions. The lens device focuses these signals onto the respective antenna feed devices. This is the exact reverse of operation in transmit mode.

Turning now in more detail to FIG. 8, a dielectric lens 81 of varying index of refraction is shown although a lens of constant index of refraction can also be used. Twenty microstrip patch antenna feeds 82 of a dielectric constant of 10.5 (a range of 5 to 15 has been established; a greater or lesser number of feeds can be used) are shown mounted parallel to the lens surface and a collar 83 for mounting the feeds 82 to the lens 81. The collar consists of upper and lower static bands 84, 85, respectively, vertical bracket beams 86 and antenna feed brackets 87. Upper and lower static bands 84, 85 may be of a variety of types and in the illustrated embodiment are of the threaded type. The collar 83 is made of delrin and nylon but other materials with dielectric constants less than 4 can also be used. The connection from the static bands 84, 85 to vertical bracket beams 88 allow movement in azimuth while the connection from the vertical bracket beams 88 to antenna feed brackets 89 allows for elevation adjustment. The antenna feed brackets 87 have a radial adjustment for focal point adjustment. In addition the antenna feed brackets 87 have provisions for mounting other feed devices and have the ability to rotate each feed and can be done in a manner obvious to one of ordinary skill. FIG. 8 shows one possible configuration of the invention with sample radiation patterns shown in FIG. 10. As noted above, the particular configuration of antenna feeds 82 with respect to each other and lens 81 may vary, such as in a V shape configuration or otherwise.

The drawings constitute a part of this specification and include an exemplary embodiment to the invention, which may be embodied in various forms. It is to be understood that in some instances various aspects of the invention may be shown exaggerated or enlarged to facilitate an understanding of the invention.

While the invention has been described in connection with a preferred embodiment, it will be understood that it is not intended to be limited to the particular embodiment shown but intended, on the contrary, to cover the various alternative and equivalent constructions included within the spirit and scope of the appended claims.

We claim:

1. A sectored antenna system, comprising:

at least one dielectric lens having a surface; and at least two antenna feed devices positioned proximate to the lens surface and tilted non-parallel to the lens surface to transmit and receive radiation directly to and from the at least one dielectric lens, at least one of the at least two feed devices having a dielectric substrate.

2. A sectored antenna system as claimed in claim 1, wherein the at least two feed devices respectively radiate first and second signals into the at least one dielectric lens, each of the first and second signals emerging from the at least one dielectric lens as a separate directional beam.

3. A sectored antenna system as claimed in claim 1, wherein the at least one dielectric lens receives incoming signals from different directions and focuses the incoming signals onto different antenna feed devices.

4. A sectored antenna system as claimed in claim 1 wherein said antenna feed devices are planar in shape.

5. A sectored antenna system as claimed in claim 1 wherein the dielectric substrate of said antenna feed devices has a dielectric constant of between about 5 and 15.

6. A sectored antenna system as claimed in claim 5 wherein said dielectric constant is about 10.

7. A sectored antenna system as claimed in claim 1, wherein the at least two antenna feed devices are angled in a V-pattern.

8. A sectored antenna system as claimed in claim 1, wherein the at least one dielectric lens has a constant index of refraction.

9. A sectored antenna system as claimed in claim 1, wherein the at least one dielectric lens has a varying index of refraction.

10. A sectored antenna system as claimed in claim 1 further comprising:

means for mounting said antenna feed devices about said lens to adjust for elevation and azimuth orientation.

11. A sectored antenna system as claimed in claim 10, wherein said means for mounting enables an adjustment of a radial position of each antenna feed device.

12. A sectored antenna system as claimed in claim 10, wherein said means for mounting enables an adjustment of a rotational orientation of each antenna feed device.

13. A sectored antenna system as claimed in claim 10, wherein said means for mounting comprises:

upper and lower static bands;

vertical bracket beams interconnecting the upper and lower static bands; and antenna feed brackets coupled to the vertical bracket beams.

14. A sectored antenna system as claimed in claim 13 wherein said means for mounting has a dielectric constant of about 4 or less.

15. A sectored antenna system comprising:

one or more dielectric lenses, each having a surface;

two or more antenna feed devices wherein at least one of said feed devices has a dielectric substrate with a dielectric constant of between about 5 and 15; and means for mounting the antenna feed devices about the lens, the means for mounting including upper and lower static bands, and antenna feed brackets with attached vertical bracket beams which interconnect the upper and lower static bands.

16. A sectored antenna system as claimed in claim 15 wherein at least two of said two or more feed devices radiate signals into said lens that emerge as separate directional beams.

17. A sectored antenna system as claimed in claim 15 wherein at least one of said one or more lenses receive incoming signals from different directions and focus them onto different antenna feed devices.

18. A sectored antenna system as claimed in claim 15 wherein said dielectric constant is about 10.

19. A sectored antenna system as claimed in claim 15 wherein said two or more antenna feed devices are angled in a V pattern.

20. A sectored antenna system as claimed in claim 15 wherein said means for mounting enables adjustment of radial orientation.

21. A sectored antenna system as claimed in claim 15 wherein said means for mounting enables adjustment of rotational orientation.

22. A sectored antenna system as claimed in claim 15 wherein said means for mounting has a dielectric constant of about 4 or less.

23. A sectored antenna system comprising:

one or more dielectric lens, each having a surface;

two or more antenna feed devices; and means for mounting said antenna feed devices about said lens to adjust for elevation and azimuth orientation, the means for mounting including upper and lower static bands, and antenna feed brackets with attached vertical bracket beams which interconnect the upper and lower static bands.

24. A sectored antenna system as claimed in claim 23 wherein the feed devices have a dielectric substrate having a dielectric constant of between 5 and 15.

25. A sectored antenna system as claimed in claim 23 wherein said dielectric constant is about 10.

26. A sectored antenna system as claimed in claim 23 wherein said two or more antenna feed devices are tilted non-parallel to the lens.

27. A sectored antenna system as claimed in claim 23 wherein said means for mounting enables adjustment of radial orientation.

28. A sectored antenna system as claimed in claim 23 wherein said means for mounting enables adjustment of rotational orientation.

29. A sectored antenna system as claimed in claim 23 wherein said means for mounting has a dielectric constant of about 4 or less.

* * * * *